US005305579A

United States Patent [19]

Kader

[11] Patent Number: 5,305,579

[45] Date of Patent: Apr. 26, 1994

[54] DEVICE FOR EXPANDING AND SLIPPING ON BAGS

[75] Inventor: Karl-Wilhelm Kader, Hennef, Fed. Rep. of Germany

[73] Assignee: Chronos Richardson GmbH, Hennef, Fed. Rep. of Germany

[21] Appl. No.: 990,121

[22] Filed: Dec. 14, 1992

[30] Foreign Application Priority Data

Dec. 14, 1991 [DE] Fed. Rep. of Germany ..... 4141253

[51] Int. Cl.[5] ..... B65B 43/34; B65B 43/16

[52] U.S. Cl. ..... 53/459; 53/570; 53/384.1

[58] Field of Search ..... 53/570, 571, 572, 573, 53/260, 384.1, 386.1, 459

[56] References Cited

U.S. PATENT DOCUMENTS

| | | | |
|---|---|---|---|
| 3,945,173 | 3/1976 | Buzzi | 53/386.1 X |
| 4,078,358 | 3/1978 | Henderson | 53/373 X |
| 4,137,958 | 2/1979 | Golby et al. | 53/386.1 X |
| 4,182,094 | 1/1980 | Lieder et al. | 53/571 X |
| 4,305,241 | 12/1981 | Tetenborg et al. | 53/384.1 X |
| 4,345,629 | 8/1982 | Inglett, Jr. | 53/373 X |
| 4,545,184 | 10/1985 | Akiyama | 53/571 |
| 4,840,016 | 6/1989 | Muller, Jr. | 53/386.1 X |
| 4,970,847 | 11/1990 | Gradwohl | 53/386.1 X |

*Primary Examiner*—Horace M. Culver
*Attorney, Agent, or Firm*—Francis N. Carten

[57] ABSTRACT

The invention relates to a device and method for expanding bags and slipping them on to a filling neck, especially bags with side folds, which are fed individually on to an aligning table, with the bag opening being positioned at the front, there being provided at least first suction means which are supported at the aligning table and which, in the region of the bag opening, are movable against the lower bag wall; at least second suction means which are supported at the aligning table and which are movable against the upper bag wall, the two sets of suction means being removable from one another while being vacuum-loaded; a pair of expanding blades which are movable into the seams of the side folds, which are secured to first pivot elements and are pivotable around a horizontal pivot axis positioned above the aligning table; a pair of bag grips with pairs of claws which are pivotable around rotational axes positioned parallel to the plane of the aligning table and, in consequence, may be opened and closed and are arranged in such a way that they each grip the two side folds in the region of the bag opening; as well as pivot elements for the bag grips which are pivotable around the same horizontal axis positioned above the aligning table as that of the first pivot elements for the expanding blades.

19 Claims, 3 Drawing Sheets

DEVICE FOR EXPANDING AND SLIPPING ON BAGS

BACKGROUND OF THE INVENTION

The invention relates to a device for expanding bags and slipping them on to a filling neck, especially bags with side folds, which are fed individually on to an aligning table, with the bag opening being positioned at the front, i. e., at the end of the aligning table toward the filling neck, and to the bag-handling method carried out by that device. A device of the aforementioned type is known from German Offenlegungschrift No. DE 38 40 646 Al. With this device, the bags are first pulled backwards from a bag store, with the closed bottom end of the bag being positioned at the front in the conveying direction. Subsequently, with the conveying direction being reversed, the bags are pulled on to the aligning table, with the bag opening being positioned at the front. The equipment components required for this process may be used, without having to be modified, for the device in accordance with the present invention. The aligning table forms part of the device in accordance with the present invention; the means for expanding and slipping on the bags is mounted on the same frame as the aligning table.

There are prior art equipment components for expanding and slipping on bags, for example, the automatic suspension device OMPB II for open bags of Chronos Richardson GmbH, in which the bag opening may be vacuum-loaded and expanded by first suction elements which are movable towards the lower bag wall and second suction elements which are movable towards the upper bag wall and which are each arranged in the region of the front bag edge, so that the bag opening is expanded by the separation of the bag walls in the areas adjacent the open end of the bag. Furthermore, there are provided means designed as expanding arms which move into the bag opening and separate therein so that the bag opening is expanded fully. The bag is gripped and held merely by being mechanically expanded A pivot movement of the expanding arms around a horizontal axis positioned above the aligning table ensures that the bag is now slid on to a filling neck where it is held by bag clamps.

The slipping-on device of the above-described type has a disadvantage in that, in the region of the bag edges, the bag cross-section is opened fully, which means that after filling the bag it is no longer possible to produce a clearly defined side fold in the region of the bag opening. This is particularly disadvantageous when closing bags with side folds, but it also has a disadvantageous effect when closing simple flat bags without multiple side folds. When using prior art closing devices, edges of the open end of the filled bag initially had to be folded back before sealing the bag by sewing the folded edges together, which is a complicated and expensive process.

The manufacturer named Slidell (USA) produces devices for expanding and slipping on bags, in which the bags are expanded exclusively by suction means acting on the bag faces, while there are provided gripping means which, at the same time, hold the side folds of the bags, especially in the case of laterally folded bags, in their original position until the bag has been slipped on to the filling neck. The suction means exert their effect near the edge of the bag. Consequently, they restrict the freedom of movement of the bag clamps at the filling neck to be pressed against the slipped-on bag, and so before the clamping-on operation, they have to be moved back in a pivot movement from the rear of the bag too as viewed from the aligning table. Such a device is suitable for very stiff bags only, because during the high-speed slipping-on operation it is possible for the bag opening to collapse and cause a system malfunction.

SUMMARY OF THE INVENTION

The present invention is embodied in and carried out by a device for expanding and slipping on bags which permits bags even of complicated materials—be it paper, plastics or a polypropylene fabric—to be slipped on to the filling neck without the side folds opening up in the region of the bag opening. This objective is achieved by combining the following:

at least first suction means which are supported at the aligning table and which, in the region of the bag opening, are positioned near the lower bag wall; at least second suction means which are supported at the aligning table and which, in the region of the bag opening, are movable against the upper bag wall, the two sets of suction means being movable away from one another while being vacuum-loaded;

a pair of expanding blades which are movable into the bag opening near the seams of the side folds, which are secured to first pivot elements and are pivotable around a horizontal pivot axis positioned above the aligning table;

a pair of bag grips with pairs of claws which are pivotable around rotational axes positioned parallel to the plane of the aligning table and, in consequence, may be opened and closed and are arranged in such a way that they each grip the two side folds in the region of the bag opening; and pivot elements for the bag grips which are pivotable around the same horizontal axis positioned above the aligning table as that of the first pivot elements for the expanding blades.

On the one hand, this novel device is suitable for preventing the sides of the bag from opening up, especially in the case of bags comprising side folds, and on the other hand, when performing a rapid slipping-on movement, it prevents the expanded bag opening from collapsing. The device in accordance with the invention ensures the above during the entire slipping-on operation, i.e., until the bag is clamped on to the filling neck. For this purpose, the expanding blades synchronously follow the pivot movement of the bag grips from the aligning table to the filling neck. Because the expanding blades within the slipped-on bag are positioned inside the bag opening on both sides of the filling neck, and because the expanding blades can continue to pivot and be moved upwards out of the operating range of the bag clamps at the filling neck, they do not obstruct the filling neck's bag clamps. In the preferred embodiment disclosed herein, both the expanding blades and the bag grips are mounted on the same pivot elements so that a single actuating means can serve to rotate both about one horizontal axis.

In a particularly advantageous embodiment, the expanding blades are arranged at the ends of shorter pivot arms which are rotatable around a second horizontal axis positioned parallel to the first horizontal axis mentioned above on a radius which is smaller than that of the first pivot elements which rotate about the first horizontal axis, the advantage of this design being that the expanding blades can stay in the bag opening until they have reached a position where the bag opening has already been moved over the filling neck and then be rotated out of the bag opening, so that, with the bag now clamped onto the filling neck, the expanding blades and the opposed bag grips together with their pivot elements may be returned to their starting position with respect to the aligning table in order to receive the next bag. The use of common main pivot elements for the expanding blades and bag grips ensures that these components will move in synchronization as long as the actuating means for the shorter pivot arms are not operated.

In a particularly advantageous embodiment of the invention, the expanding blades are angled relative to the shorter pivot arms by approximately 90°, and the shorter pivot arms are formed with an intermediate, downward angle in the same direction of approximately 30°-50°. In this way, the expanding blades at the free ends of the shorter pivot arms can easily be introduced into the opened end of the bag without any parts of the pivot arms coming into contact with the edges of the bag opening, i.e., the bag rim The longitudinal axes of the expanding blades at the free ends of the shorter pivot arms are preferably parallel to the plane of the aligning table when they are moved into the opened end of the bag In an advantageous embodiment, the aligning table comprises a front end stop flap for the front bag edge, which is positioned in the pivot path of the expanding blades and which may be downwardly folded or moved away therefrom. In this way, it is possible to align the bag accurately by moving it forward against the stop flap and then to grip it laterally by means of the bag grips so that it is fixed in its position. Subsequently, the stop flap may be folded away and the bag may be expanded by the suction means. In a final operational movement, the expanding blades are moved in. This event is followed by a rapid pivot movement of both the bag grips and the expanding blades along an arc towards the filling neck. In addition to the said foldable front stop flap, the aligning table may comprise adjustable side guiding flaps.

The present invention is advantageously employed in combination with the bag clamping device disclosed and claimed in the copending U.S. Pat. application entitled BAG CLAMPING DEVICE filed on even date herewith by the present inventor and assigned to Chronos Richardson GmbH, and the disclosure of said application is incorporated herein by reference.

DESCRIPTION OF THE DRAWINGS

The written description of the present invention will be more fully understood when read with reference to the accompanying drawings, of which.

DETAILED DESCRIPTION OF THE PREFERRED EMBODIMENT

Figure 1:
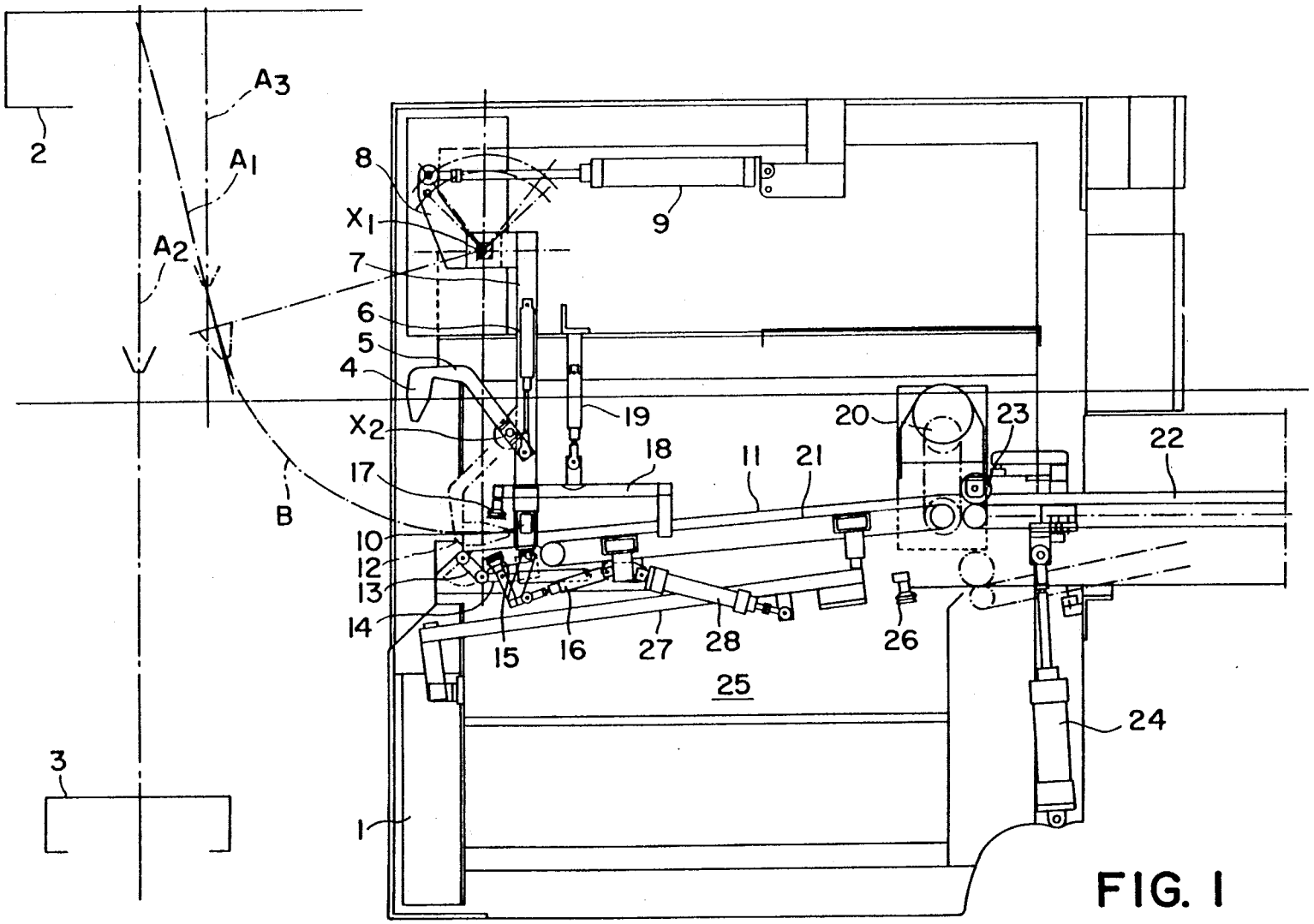
FIG. 1 shows a side elevation of a preferred embodiment of the device in accordance with the invention.

The best mode of carrying out the invention is shown in the aforementioned drawing figures and is described in detail hereunder. Referring now specifically to FIG. 1, there is shown a longitudinal section of a machine frame 1 in front of which there is depicted, in outline, a filling machine 2 and a transversely passing conveyor belt 3 The filling neck may be part of a variety of filling machines including, but not limited to, a machine with a fixed single spout; a machine with a swivelled single spout; a six-spout carousel machine; a GE55 gross weigher; and a three-spout carousel machine with desecration capability. In the embodiment shown, longitudinal axis $A_1$ refers to a first position of a pivotable filling neck (not illustrated in detail) in which the bag may be slipped on. This axis $A_1$ extends tangentially relative to the arc B of expanding blades 4 and bag grips 10 (hereafter to be described in greater detail) during the movement of pivot arms 37 around a first pivot axis $X_1$. Longitudinal axis $A_2$ refers to a second position of the pivotable filling neck in which it is pivoted back into the vertical plane, this position being located centrally and perpendicularly above the conveyor belt 3. Longitudinal axis $A_3$ illustrates a third position of a filling neck which is vertical and non-pivotable, and which would require a different position of the conveyor belt 3. The expanding blades 4 are movable in their own arcuate path around a horizontal pivot axis $X_2$, as shown by their two end positions, relative to the pivot elements movable around the horizontal pivot axis $X_1$. The expanding blades 4 are at the free ends of shorter pivot arms 5 which may be rotated by actuating air cylinders 6. The pivot elements mentioned first comprise pivot arms 7 and the pair of lever arms 8 which may be rotated around axis $X_1$ by actuating air cylinders 9 connected between the free ends of lever arms 8 and frame 1. At the free ends of the pivot arms 7 there are arranged bag grips 10 with pairs of claws which are positioned approximately in the plane of an aligning table when the pivot arms 7 assume the position as illustrated. At the front end of the aligning table is a stop flap 12 against which a bag may be stopped for aligning purposes. The stop flap 12 may be folded away by a pivot lever 13 and an actuating air cylinder 14 into an approximately horizontal position so as to be out of the path of the expanding blades 4. For opening a bag conveyed to the aligning table 11, there are provided lower suction apparatus 15 of conventional construction and operation which may be moved towards the bag plane via levers and actuating air cylinders 16, as well as upper suction apparatus 17 of conventional construction and operation which may be lowered on to the bag plane via a pivot arm 18 and upper actuating air cylinders 19. After the suction apparatus 15, 17 has subjected the bag walls to vacuum, their movements may be reversed and they may be returned into the positions as illustrated, as a result of which the open end of a bag conveyed to the aligning table 11 is opened The bags are conveyed, one after another, to the aligning table 11 by a belt loop 21 driven by a motor 20 with a belt drive. Behind the aligning table 11 there is positioned a pulling-in assembly 22 for bags whose front driving pulley 23 may be driven in both directions and which is pivotable by an actuating cylinder 24 between the position illustrated in continuous lines and that illustrated in dashed lines. In the lower position shown in dashed lines, individual bags are removed from the bag store by lowering suction means 26 on to the pile of bags (not illustrated), by loading them with vacuum and lifting them off the pile of bags. For this purpose, a pivot arm 27 is provided above the bag store, which, via a lifting air cylinder 28, is able to carry out the movements mentioned. The suction means 26 are longitudinally displaceable relative to the pivot arm so that when the suction means move forward into the position illustrated in continuous lines, the bottom end of the bag positioned in front may already be gripped and pulled in by the pulley 23 of the pulling-in assembly 22. Subsequently, the pulling-in assembly 22 is moved into the upper position illustrated in continuous lines and the driving direction is reversed.

Figure 2:
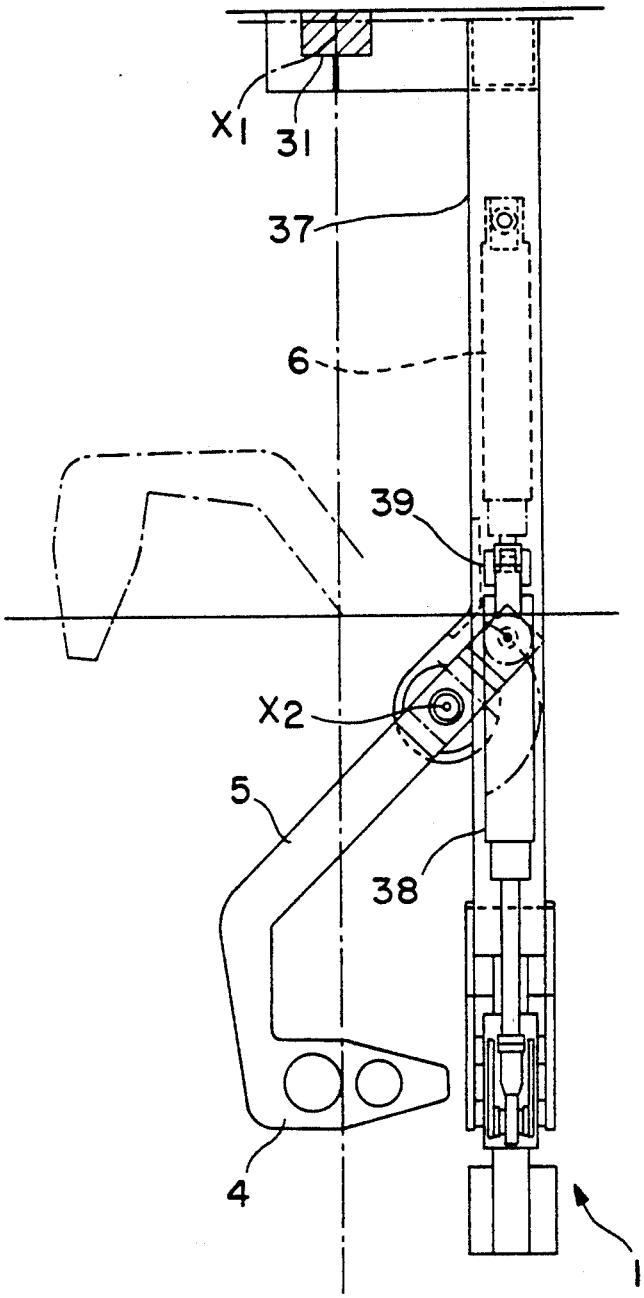
FIG. 2 shows, in enlarged detail, the pivot elements for the bag grips and the expanding blades according to FIG. 1.
Figure 3:
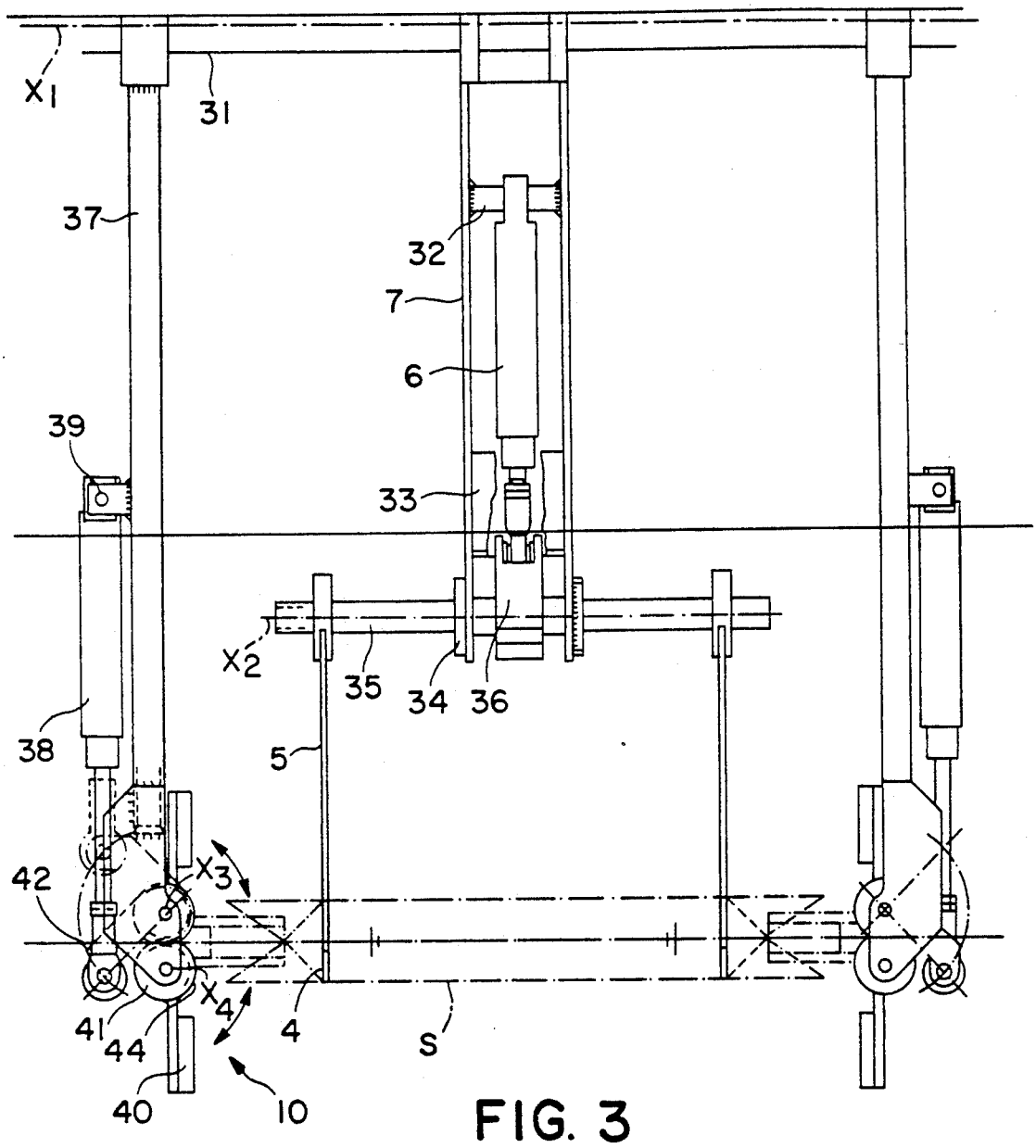
FIG. 3 shows a front view of the pivot elements and expanding blades according to FIG. 2.

FIG. 2 shows a side elevation of the detail illustrated in the form of a longitudinal section 1. FIG. 3 shows a front view. Both will be described jointly below.

Pivot arms 7 are secured to a rotary beam 31 and connected thereto and to one another via a first rotary journal 32 and a connecting member 33, with the air cylinder 6 mounted in the space between them. The shorter double pivot arms 5, carrying the expanding blades 4 at their free ends, are themselves rotatably mounted at the free ends of pivot arms 7. In front bearing bushes 34 there is held a rotational member 35 which carries the arms 5 directly and which is rotated by the actuating air cylinder 6 via the lever 36. The pivot arms 37 are also provided in pairs; in the side elevation they cover the air cylinder 6, which is shown in phantom in FIG. 2. The pivot arms 37 are also non-rotatingly connected to the rotary beam 31; they are not connected to one another. On the outside of the pivot arms 37, actuating air cylinders 38 are supported in bearing journals 39 which serve to actuate the bag grips 10 provided in pairs. Each bag grip 10 comprises pairs of claws 40 which are pivotable on rotary journals 41 around parallel rotational axes $X_3$, $X_4$. In each case, only one of the journals 41 is driven directly by a lever 42. The rotary journals engage via teeth 44 so that they are driven by the actuating air cylinders 38 in opposite directions. As a result, it is possible to pivot the claws 40 into the closed position illustrated in broken lines. In FIG. 3, the bag S with side folds is illustrated in dashed lines, with the expanding blades 4 having been moved into it.

In the embodiment described above, the novel sequencing of events in the operation of the device for expanding and slipping a bag onto a filling neck is effected by known technology, preferably proximity switches on the various air cylinders to detect the position of the air-driven piston therein and, from the indication of the position of that piston, determining whether a particular step in the novel sequence of steps carried out by the device has been completed. In order not to unduly complicate the drawings and thereby obscure the invention, such conventional elements as vacuum hoses, vacuum source, sensors and their connections and related circuitry have not been shown.

Certain modifications and variations of the disclosed embodiment of the present invention will be apparent to those skilled in the art. It should be understood that the disclosed embodiment is intended to be illustrative only, and not in any way restrictive of the scope of the invention as defined by the claims set forth hereunder.

I claim:

1. In a system for filling bags in which the bags are fed individually onto an aligning table with the bag opening being positioned at the front, the improvement comprising a device for expanding bags and slipping them on to a filling neck, said device comprising:

(a) first suction means which are supported at the aligning table;

(b) second suction means which are supported at the aligning table and disposed opposite said first suction means, said first and second suction means being movable away from one another while being vacuum-loaded so as to open the bag;

(c) a pair of bag grips disposed opposite one another, each comprising a pair of claws which may be opened and closed to grip a portion of the opposing sides of the bag in proximity to the open end of the bag;

(d) first pivot means comprising first pivot arms with said bag grips arranged at their free ends, said first pivot arms being pivotable around a first horizontal axis positioned above the aligning table; and (e) second pivot means comprising second pivot arms shorter than said first pivot arms and having a pair of expanding blades arranged at their free ends, and pivotable around a second horizontal axis parallel to said first horizontal axis on a radius which is smaller than that of the first pivot arms, said pair of expanding blades being movable into the open end of the bag by rotation of first pivot arms rotating about said first horizontal axis.

2. The device according to claim 1, wherein said first and second pivot arms for said bag grips and said expanding blades, respectively, are connected to one another and to joint actuating means.

3. The device according to any one of claim 1 or 2, wherein said expanding blades are angled relative to said second pivot arms by approximately 90°, and said second pivot arms are formed with an intermediate downward angle in the same direction between approximately 30° and 50°.

4. The device according to any one of claim 1 or 2, wherein said first and second pivot arms for said bag grips and said expanding blades, respectively, are firmly attached to a joint rotary beam.

5. The device according to any one of claim 1 or 2, wherein said aligning table comprises an end stop flap which is positioned in the pivot of said expanding blades and which may be downwardly folded or moved away therefrom.

6. The device according to any one of claim 1 or 2, wherein said aligning table comprises adjustable side stop flaps.

7. Apparatus for expanding and slipping the open ends of bags onto a filling neck which is located at a predetermined location for at least a predetermined time period, comprising:

(a) aligning means for receiving and positioning a bag in a predetermined position;

(b) means operative to separate the opposite walls of the bag near the open end of the bag when the gag is moved into said predetermined position;

(c) a pair of expanding blades mounted on a second pair of pivot arms rotatable around a second pivot axis by second actuating means operative, when said opposite walls of the bag near the open end of the bag have been separated, to rotate said pair of expanding blades into the open end of the bag, each expanding blade then being in proximity to one of the sides of the open end of the bag;

(d) a pair of opposed gripping means, each mounted on one of a first pair of opposed pivot arms, which are rotatable around a first pivot axis parallel to said second pivot axis and controlled by a first actuating means and operative, when said pair of expanding blades are rotated into the open end of the bag, to grip a portion of the opposing sides of the bag in proximity to the open end of the bag;

(e) said first actuating means being operative, when the opposing sides of the bag in proximity to the open end of the bag have been gripped by said pair of opposed gripping means, to swing the open end of the bag in an arcuate path from said aligning means to the filling neck and to swing said pair of expanding blades and said opposed gripping means in synchronization with the open end of the bag toward the filling neck; and (f) said second actuating means being further operative to rotate said second pair of pivot arms to remove said expanding blades from the open end of the bag at a predetermined point along said arcuate path.

8. The apparatus according to claim 7, wherein said aligning means comprises an aligning table having a moveable front end stop flap and means operative, after a bag is received and positioned in a predetermined position, to move said front end stop flap away from the open end of the bag so as to enable said expanding blades to be moved in and the bag to be moved along said arcuate path.

9. The apparatus according to claim 8, wherein said aligning means further comprises adjustable side guiding flaps.

10. The apparatus according to claim 7, wherein said first pair of pivot arms are fixedly mounted on a rotary beam which is rotatably mounted above said aligning means by a frame.

11. The apparatus according to claim 10, wherein said second pair of pivot arms are rotatably mounted on an intermediate pair of pivot arms which are fixedly mounted on said rotary beam between said first pair of pivot arms.

12. The apparatus according to claim 11, wherein said first actuating means is operative to rotate both said intermediate pair of pivot arms and said first pair of opposed pivot arms to cause said pair of opposed gripping means and said pair of expanding blades to move in synchronization until reaching said predetermined point along said arcuate path.

13. The apparatus according to claim 12, wherein, when said pair of opposed gripping means and said pair of expanding blades reach said predetermined point along said arcuate path, said second pair of pivot arms rotates with respect to said intermediate pair of pivot arms to remove said pair of expanding blades from the open end of the bag.

14. The apparatus according to claim 7, wherein said second pair of pivot arms are formed with an intermediate, downward angle between approximately 30° and 50°.

15. The apparatus according to claim 7, wherein, when the bag has side folds, said pair of opposed gripping means prevent the side folds from unfolding in the region near the open end of the bag.

16. The apparatus according to claim 15, wherein said pair of expanding blades are spaced away from said pair of opposed gripping means so that said pair of expanding blades clear the side folds of the bag

17. The apparatus according to claim 7, wherein said pair of opposed gripping means each comprises a pair of claws rotatable toward each other to grip a portion of one side of the bag in proximity to the open end of the bag.

18. The apparatus according to claim 17, wherein each of said pair of claws is rotatable from a vertical position to a horizontal position by synchronizing actuating means.

19. A method of expanding and slipping the open ends of bags onto a filling neck which is located at a predetermined position for at least a predetermined time period, comprising essentially the steps of:

(a) positioning a bag in a predetermined position with respect to said filling neck;

(b) separating the opposite walls of the bag near the open end of the bag;

(c) expanding the open end of the bag by moving a pair of expanding blades into the open end of the bag;

(d) gripping the opposing sides of the bag in proximity to the open end of the bag by closing opposed pairs of grips;

(e) swinging the open end of the bag in an arcuate path from said predetermined position to the filling neck, with the expanding blades and the opposed pairs of grips moving in synchronization with one another for a predetermined arcuate distance; and (f) moving the expanding blades out of the open end of the bag at a predetermined point along said arcuate path.

* * * * *